United States Patent [19]

Mackey

[11] 4,250,811

[45] Feb. 17, 1981

[54] BLAST HOLE LINER

[75] Inventor: Illa J. Mackey, Iron, Minn.

[73] Assignee: Mesabi Jobbers, Inc., Virginia, Minn.

[21] Appl. No.: 955,380

[22] Filed: Oct. 27, 1978

Related U.S. Application Data

[63] Continuation-in-part of Ser. No. 805,789, Jun. 27, 1977, abandoned.

[51] Int. Cl.[3] ..... F42B 3/00

[52] U.S. Cl. ..... 102/24 R

[58] Field of Search ..... 102/22 R, 23, 24 R

[56] References Cited

U.S. PATENT DOCUMENTS

| | | | |
|---|---|---|---|
| 3,760,727 | 9/1973 | Callister et al. | 102/24 R |
| 3,881,417 | 5/1975 | Mesia | 102/24 R |
| 4,019,438 | 4/1977 | Swanson, Jr. | 102/24 R |

FOREIGN PATENT DOCUMENTS

| | | | |
|---|---|---|---|
| 667051 | 7/1963 | Canada | 102/24 R |

*Primary Examiner*—Leland A. Sebastian

*Attorney, Agent, or Firm*—James R. Haller

[57] ABSTRACT

A blast hole liner comprised of a single length of waterproof, flattened, longitudinal tubing having an open upper end and a lower end portion terminating in a bottom edge folded about its midpoint with resulting edge halves joined together to define an upwardly open weight pocket. The liner is provided with a transverse seal above the pocket. The latter seal may be located closely adjacent a horizontal crease in the tubing formed by doubling the same back upon itself. In one embodiment, manufacture of the liner from a length of tubing requires no further cutting or slitting of the tube. In another embodiment, a second length of tubing, substantially congruent with the first-mentioned tubing length, may be provided to improve the strength and waterproof nature of the liner and to protect the innermost length of tubing from becoming torn or punctured. In the preferred embodiment, an inner length of tubing is disposed independently within the first tubing, such that the first tubing length alone is primarily subject to stresses incurred due to the weight pocket and filling of the inner tubing with explosive.

13 Claims, 11 Drawing Figures

BLAST HOLE LINER

This is a continuation-in-part of my earlier application filed June 27, 1977, Ser. No. 805,789, now abandoned, for BLAST HOLE LINER.

BACKGROUND OF THE INVENTION

In the mining industry, a favored explosive material comprises ammonium nitrate and fuel oil (commonly known as "ANFO"). This explosive may be used by forming (by drilling or jet piercing) holes ("blast holes") in the ore body, filling the holes with ANFO, and then detonating the explosive. The water which collects in blast holes, either from rain or surface water or from underground sources, has a deleterious affect on ammonium nitrate, and as a result blast holes are commonly lined with a waterproof, plastic liner to keep the water from the explosive. The empty liners are inserted into the blast holes, and the liners are later charged with explosives.

Insertion of blast hole liners into blast holes is ordinarily accomplished by weighting the leading edge of the liner with weighting material, such as may be found at the blast hole site. The weighting material may be inserted into pouches or pockets located in the leading edge of the liner. Blast hole liners of this general type are shown in Canadian Pat. No. 667,051, U.S. Pat. No. 4,019,438 and commonly owned U.S. Pat. Nos. 3,881,417 and 3,760,727. Certain of these liners are quite complex in construction, and accordingly are rather expensive to fabricate. Since it is not practical to test the waterproof qualities of individual blast hole liners before insertion thereof in the blast holes, for safety reasons liner manufacturers tend to make blast hole liners perhaps unnecessarily strong in an effort to assure that the liners will not fail at use, which effort adds to the cost of the liner. Such liners generally are made of tubular plastic stock, and are assembled by means of various cutting and numerous heat seals, as shown, for example, in U.S. Pat. Nos. 3,760,727 and 4,019,438. Certain of such liners are so designed with weight pockets as to transmit stresses incurred upon filling with explosive to an otherwise waterproof tube, the stresses tending to rip the latter or to destroy waterproof seals.

It would be desirable to provide a blast hole liner which could be easily and inexpensively manufactured, which would require few if any cutting procedures for the liner stock, which would require a minimum of heat sealing, and which would reduce the transfer of stresses incurred upon filling the liner with explosive.

SUMMARY OF THE INVENTION

The present invention provides a blast hole liner which can be very simply and easily manufactured and which provides a minimum of heat sealing and cutting during fabrication of the liner.

The liner of the invention includes an integral weight pocket, and comprises a single length of waterproof, flattened, longitudinal tubing having an open upper end and a lower end portion terminating in a bottom edge. The bottom edge is folded about its midpoint to define two halves, and the edge halves are joined together to define an upwardly open pocket to receive weighting material. The liner includes a waterproof seal extending transversely across the lower end portion of the tubing adjacent the weight pocket. In one embodiment, the lower end portion of the tubing is doubled back upon itself to define a transverse crease, and the tubing is provided with a transverse seal joining together the tubing sections on either side of but closely adjacent the crease and providing the lower edge portion of the tubing with the transverse, waterproof seal. A second length of waterproof tubing may be provided which is substantially congruent with the first-mentioned length of tubing. In a preferred embodiment, the tubing is provided with an independent inner liner sealed at its bottom. The first tubing alone is made primarily subject to the stresses incurred due to the weight pocket while lowering the weight pocket into a blast hole, and particularly while filling the inner liner with explosive.

DESCRIPTION OF THE PREFERRED EMBODIMENT

Figures 1, 2, 3, 4, 5:
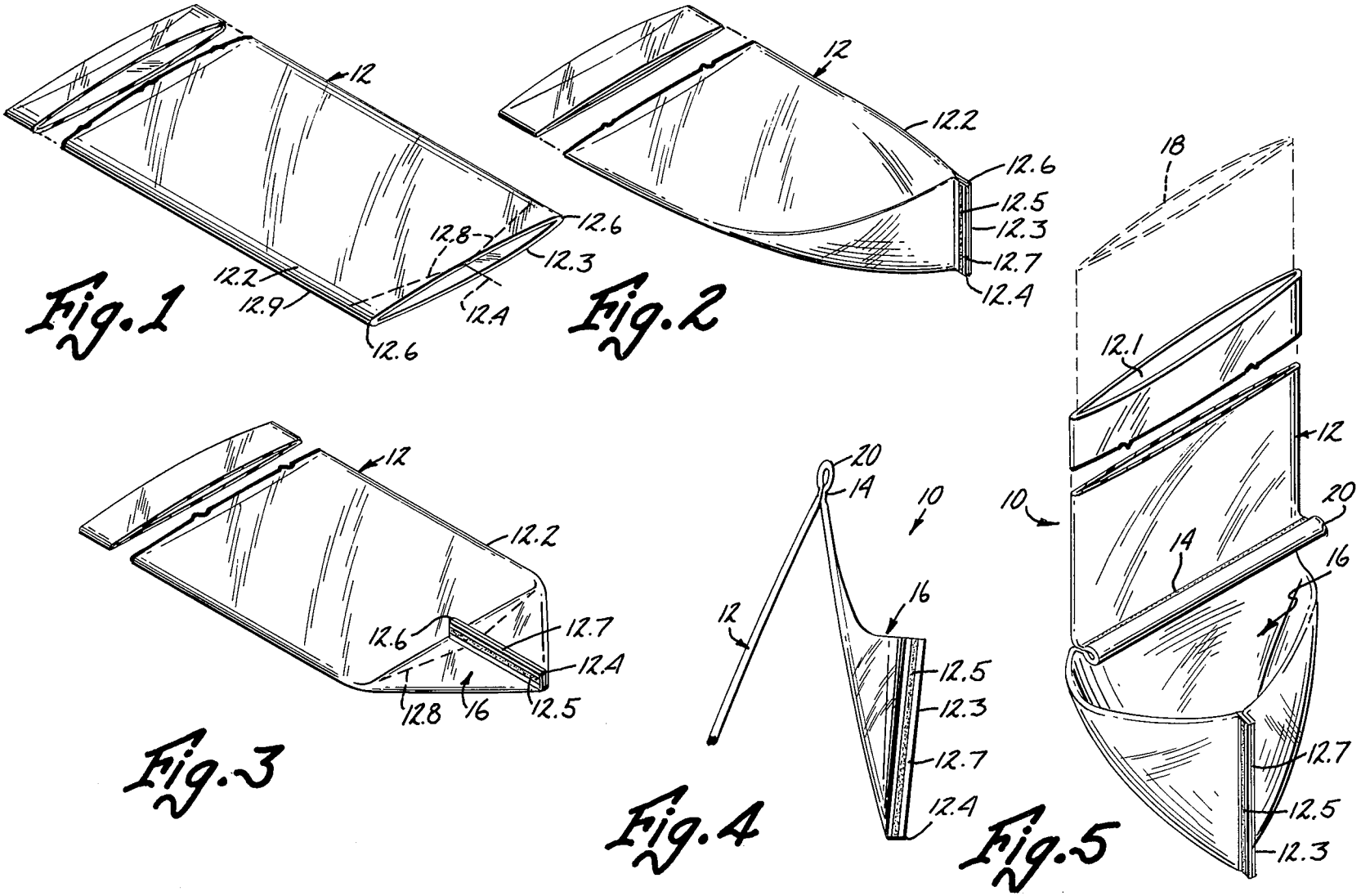
FIGS. 1–4 inclusive show the blast hole liner of the invention at various stages of manufacture, FIGS. 1–3 being broken-away perspective views, and FIG. 4 being a broken-away side view.
FIG. 5 is a perspective view of a blast hole liner of the invention in finished form.
Figure 6:
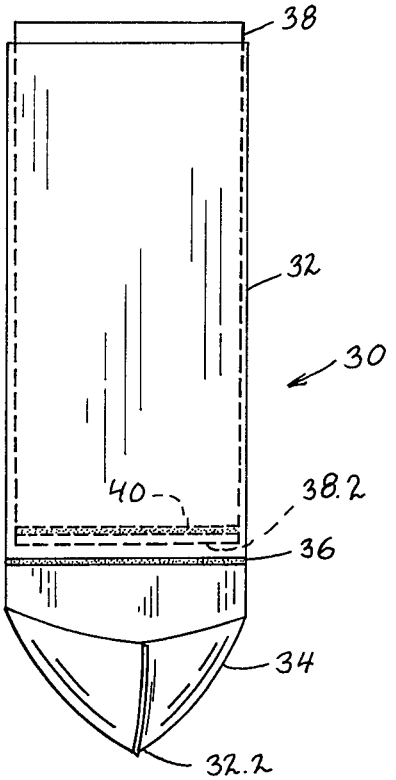
FIG. 6 is a front elevational view of another embodiment of the invention.

The blast hole liner of the invention is depicted generally by the numeral 10 as shown in the drawings, and is formed of a single length 12 of waterproof, flattened, longitudinal tubing having an open upper end 12.1. The lower end of the liner is provided with a transverse seal 14, and a distal weight pocket 16 for reception of weighting material. If desired, a second length of tubing, shown in phantom lines in FIG. 5 as an inner tubing 18, may be provided in substantial congruity with the tubing 12 to reinforce the liner.

The liner of the invention may be better understood by reference to the method by which it is made. FIG. 1 depicts a single length 12 of waterproof, flattened, longitudinal tubing which may be cut from a continuous storage roll of such tubing. The tubing 12 has a lower end portion, designated 12.2 terminating downwardly in a bottom edge 12.3, the bottom edge being desirably straight and normal to the longitudinal direction of the tubing. The bottom edge 12.3 is folded about its midpoint 12.4 into two edge halves which are brought together in facing engagement with one another and which are then joined together, by a heat seal or other means, to form a joint shown as 12.5 in the drawing, the seal or joint preferably being spaced inwardly of the edge 12.3 a short distance to provide a graspable tab 12.7. The portion of the joint nearer the ends 12.6 of the bottom edge of the liner are then folded back against the body of the liner, as shown in FIG. 3, to provide a flattened, easily stored structure defining a weight pocket 16. It will be understood that the pocket may be opened to receive weighting material merely by pulling outwardly upon tab 12.7.

The lower end portion of the tubing 12 may be folded back upon itself as shown in FIG. 4 to form a transverse crease 20 above the weight pocket 16. The tubing sections on either side but closely adjacent the crease 20 are joined together by a heat seal 14 to provide the lower end portion with a transverse, waterproof seal and to also seal the interior of that portion of the tube forming a pocket from the interior of the tubing portion above the crease 20. It will be understood that the heat seal 14 is spaced from the crease 20 by only a very short distance; i.e., not greater than about one inch. The seal 14 hence can be made by common heat sealing equipment commonly used to seal together the edges of plastic films.

It will now be understood that no cutting operations are required to form the liner depicted in FIGS. 1-5 from a length of tubular material. Further, when the material is heat-sealable, only one heat seal 14 need be made, and that heat seal may be located closely adjacent an edge (represented by crease 20) of the material, thereby facilitating the use of inexpensive heat sealing machinery. The joint 12.5, it will be understood, need not be a waterproof joint but may be conveniently formed by heat sealing or by sewing, or the like. Because of the lack of subsequent cutting operations, the risk of tearing the liner during manufacture is greatly reduced, and the entire liner as depicted in FIG. 5 can be produced by a skilled operator from a length of tubing within seconds. Because of the simplicity of the operation, the chances for operator error leading to subsequent failure of the liners of the invention is minimized.

As noted above, a second length of tubing may be employed in the liner of the invention, the latter tubing being substantially congruent with the outer tubing 12 and being positioned either interiorly or exteriorly of the outer tubing 12. The lower end of the second length of tubing (which tubing is shown in phantom lines in FIG. 5 and is designated 18) may extend into and become part of the weight pocket 16, or may terminate above the weight pocket. The second length of tubing may be incorporated in the heat seal 14, or at least be provided with its own transverse, waterproof seal adjacent the seal 14.

The embodiment in which the inner length of tubing is provided with its own transverse, waterproof seal is depicted in FIGS. 6 through 11 by the numeral 30. This embodiment includes a first length of outer tubing 32 similar to the outer tubing 12 disclosed above, in that a weight pocket 34 is constructed of the tubing material in like fashion. The transverse heat seal 36 may be identical to the heat seal 14 disclosed above, or may be simply formed through the thickness of the outer tubing 32 without folding the tubing back upon itself.

An inner tubing 38 is disposed within that portion of the outer tubing 32 located above the transverse heat seal 36. The lower end 38.2 of the inner tubing 38 is closed and made watertight by the use of a transverse heat seal 40.

It is important to note that the inner tubing 38 is independent of the outer tubing 32. That is, the inner tubing 38 is not connected or attached to the outer tubing 32. The importance of this will be made clear below.

Figure 7:
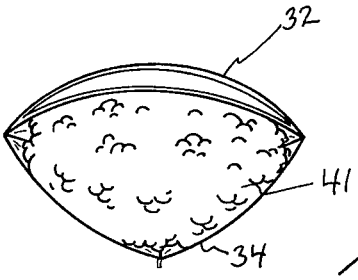
FIG. 7 is a top plan view of FIG. 6, wherein the weight pocket is filled with cuttings.

To facilitate lowering the liner 30 into a blast hole, the weight pocket 34 is filled with cuttings or the like to provide a relatively flexible yet weighty bulk at the lower end 32.2 of the liner. FIG. 7 illustrates the weight pocket 34 as being so filled by cuttings 41.

Figure 8:
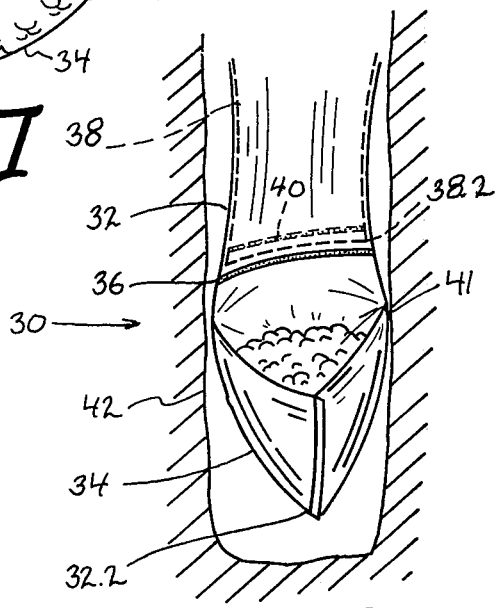
FIG. 8 is a front elevational view of this embodiment of the invention being lowered into a blast hole, the blast hole being cut away to provide greater clarity.

FIG. 8 depicts the lower end 32.2 being lowered into a blast hole 42. It should be noticed in FIGS. 7 and 8 that while the outer tubing 32 is somewhat transversely curved due to the weight of the cuttings 41, the transverse heat seal 36 is sufficiently stiff to discourage or restrain the tubing material from curving further inwardly, or from folding in upon itself.

Figure 9:
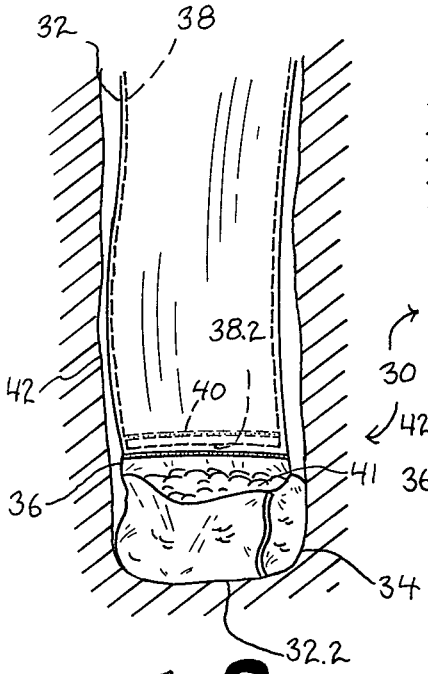
FIG. 9 is a front elevational view of the invention of FIG. 8 showing the invention completely lowered into the blast hole.
Figure 10:
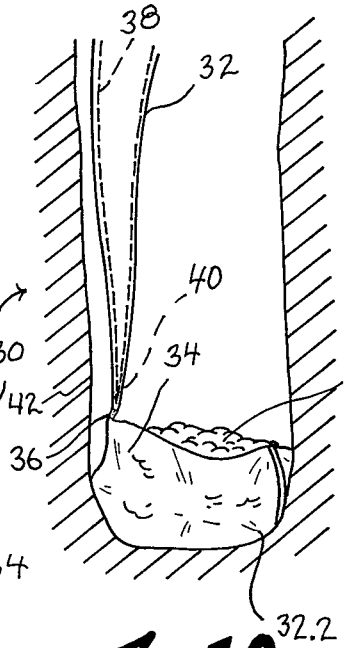
FIG. 10 is a side elevational view of FIG. 9.

Referring now to FIGS. 9 and 10, the weight pocket 34 is shown at rest on the bottom of the blast hole 42. Due to the flexible nature of the tubing material and of the settling capabilities of the cuttings 41, the weight pocket 34 loses its bullet-shaped configuration upon contacting the bottom of the blast hole 42 and seeks rather to conform itself to the shape of the bottom of the blast hole.

It should be noted in FIG. 10 that the transverse heat seal 36 is not centrally located in the blast hole 42 when the weight pocket 34 is at rest. In fact, the transverse heat seal 36 is located somewhat proximal the side of the blast hole.

Figure 11:
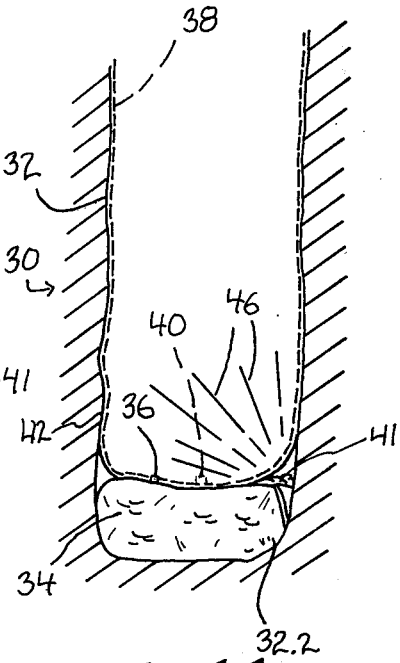
FIG. 11 is a side elevational view showing the invention filled with explosive while in the blast hole.

FIG. 11 depicts the blast hole liner 30 filled with explosive while located in the blast hole 42. Since the explosive exerts a strong downward force due to its weight, a further settling of the cuttings 41 may be forced. Even with such settling, however, the transverse heat seal 36 of the outer tubing 32 will not become centrally located. As shown, this heat seal 36 remains located off-center. The heat seal 40 of the inner tubing 38, however, is not so limited, and the inner tubing 38 will therefore adjust and position itself within the outer tubing 32 to most easily receive the greatest amount of explosive. This will generally mean that the heat seal 40 of the inner tubing 38 will center itself in the blast hole 42.

Due to the nature of the tubing material (which material will be described more fully below) the outer tubing 32 will stretch, if necessary, to accommodate the filling inner tubing 38. This stretching is depicted in FIG. 11 by stretch lines 46. It should be clear that the more off-center the heat seal 36 of the outer tubing 32 becomes, the more the outer tubing 32 must stretch to accommodate the weighty explosive.

Some advantages of this embodiment 30 may be summarized as follows: The weight pocket 34 design allows the blast hole liner to be lowered into a blast hole, very efficiently, and further lends itself to inexpensive and reliable manufacture. The center of the bottom of the tube 32, as represented by the transverse heat seal 36, may become located off-center when fully lowered, however. When the liner is filled with explosive, one side of the tube 32 will become stretched. Such stretching may cause the tube 32 to crack or split or otherwise to leak. That potential is alleviated here by the provision of an inner tube 38 that remains independent of the outer tube 32. The inner tubing 38 is allowed a degree of freedom within the outer tubing 32 such that it may locate itself to a position of least stress, with the result that generally no one side of the inner tubing 38 will become inordinately stressed. Consequently, the waterproof nature of the tubing 38 will remain basically unaffected.

The liners of the invention are desirably stored in separate rolls with the weight pockets 16 being at the exterior of the rolls. In use, a short length of the liner is pulled from the roll and the tab 12.7 is pulled away from the body of the liner to open and expose the weight pocket 16. Weighting material, such as cuttings found about the blast hole site, are inserted in the pocket and the tubing may be lowered within a prepared blast hole.

The tubing lengths referred to above as 12, 18, 32 and 38 may be made of any convenient waterproof material such as polyethylene, polybutylene, and the like, and is preferably heat sealable to facilitate the formation of waterproof seals. If two tubing sections are employed in congruent relationship as described above, it is desired that the outer length of tubing be of a material which is particularly resistant to tearing or abrasion; polybutylene (e.g., PB-131, Witco Chemical Corporation, a high molecular weight, isotactic polymer synthesized from butene-1) has given excellent results in this regard. The outer tube of polybutylene preferably is employed at a thickness of about 0.004 inches. The inner tubing is selected so as to be highly resistant to water and to oil from an explosive such as ANFO, and desirably is made of low density polyethylene at a thickness of about 0.006 inches.

With reference again to FIGS. 1 and 3 of the drawing, while it is desired that the bottom edge of the tubing forming the weight pocket be cut generally square (that is, generally normal to the length of the tubing) in some instances it may be desirable to cut the tubing at a slight angle to the normal, as shown by dashed lines 12.8 in FIGS. 1 and 3. When the lower edge 12.3 of the tube is thus folded about its midpoint 12.4, the weight pocket 16 which is thus formed has somewhat steeper sides, providing the pocket with a more pointed configuration and retaining weighting material more securely therein. The edges 12.3, in this manner, form an acute angle with the length of the liner. Preferably, however, the bottom edge 12.3 is cut normal to the length of the liner, that is, at 90° to the liner edges 12.9, thereby reducing the labor involved in manufacturing the liner.

Thus, manifestly I have provided a blast hole liner with an integral weight pocket that is simple and inexpensive to manufacture and is hence likely to contain fewer defects than the more complex liners which have been employed in the past. The liner of my invention requires a very minimum of cutting and sealing operations, and can be mass produced quickly and accurately. In a preferred embodiment, the inner length of tubing may move relative to the liner as explosive is added, thereby reducing stress concentrations and improving the waterproof characteristics of the liner.

While I have described a preferred and a second embodiment of the present invention, it should be understood that various changes, adaptations, and modifications may be made therein without departing from the spirit of the invention and the scope of the appended claims.

What is claimed is:

1. A blast hole liner with an integral weight pocket comprising a single length of waterproof, flattened, longitudinal tubing having an open upper end and a lower end portion terminating in a bottom edge folded about its midpoint to define two halves with the edges of the halves joined together to define an upwardly open pocket to receive weighting material, and means providing a stiffening waterproof seal extending transversely of the lower end portion of the tubing adjacent the weight pocket and above said mid-point.

2. The blast hole liner of claim 1 in which the waterproof seal is sufficiently stiff to restrain folding of the seal when weighting material is placed in the weight pocket.

3. The blast hole liner of claim 1 wherein the liner includes a second length of tubing with a seal at its lower end and carried in substantial congruity within said single length of tubing, said second length of tubing having said lower end unconnected to said single length of tubing.

4. The blast hole liner of claim 3 wherein said second length of tubing is unconnected to said single length of tubing.

5. A blast hole liner with an integral weight pocket comprising a single length of waterproof, flattened, longitudinal tubing having an open upper end and a lower end portion terminating in a bottom edge folded about its midpoint to define two edge halves with the halves joined together to define an upwardly open pocket to receive weighting material, the tubing above but adjacent the pocket being doubled back upon itself to define a transverse crease, and the tubing sections on either side of but closely adjacent the crease being joined together to provide the lower end portion of the tubing with a transverse stiffening waterproof seal.

6. The blast hole liner of claim 5 wherein the edge halves, where joined together, form a joint at an acute anle with the length of the liner.

7. The blast hole liner of claim 5 wherein the liner includes a second length of tubing with a seal at its lower end and carried in substantial congruity with said single length of tubing.

8. The blast hole liner of claim 7 wherein said second length of tubing is carried within the said single length of tubing.

9. The blast hole liner of claim 7 wherein the second length of tubing exteriorly sheaths the said single length of tubing.

10. The blast hole liner of claim 7 wherein the second length of tubing terminates downwardly above the weight pocket.

11. Method of easily forming a blast hole liner with an integral weight pocket from a single length of waterproof, flattened, longitudinal tubing having an open upper end and a lower end portion terminating the bottom edge, comprising folding the bottom edge about its midpoint to define two edge halves, joining the edge halves together to define an upwardly open pocket to receive weighting material, and sealing the tubing with a stiffening waterproof seal extending transversely of the lower end portion adjacent the pocket.

12. Method of easily manufacturing a blast hole liner with an integral weight pocket from a single length of waterproof, flattened longitudinal tubing having an open upper end and a lower end portion terminating in a bottom edge, comprising folding the bottom edge about its midpoint to define two edge halves, joining the edge halves together to define an upwardly open pocket to receive weighting material, doubling the lower end portion back upon itself to define a transverse crease above the pocket, and sealing together the tubing sections on either side of but closely adjacent the crease to provide a waterproof stiffening transverse seal.

13. A blast hole liner with an integral weight pocket, comprising a first length of substantially flattened tubing having an open upper end and a lower end portion terminating in a bottom edge folded about its midpoint to define two bottom edge halves with the halves joined together to form an upwardly open pocket for receiving weighting material, the first length of tubing having a stiffening transverse seal adjacent the weight pocket, and an inner length of waterproof flattened tubing received substantially congruently within the first length of tubing but terminating above said transverse seal, the inner tubing having a waterproof seal at its lower end and being free to move at its lower end within the first tubing length.

* * * * *